US010243251B2

(12) United States Patent
Gok et al.

(10) Patent No.: US 10,243,251 B2
(45) Date of Patent: Mar. 26, 2019

(54) MULTI-BAND ANTENNA FOR A WINDOW ASSEMBLY

(71) Applicants: AGC AUTOMOTIVE AMERICAS R&D, INC., Ypsilanti, MI (US); AGC Flat Glass North America, Inc., Alpharetta, GA (US)

(72) Inventors: Gurkan Gok, Ann Arbor, MI (US); Jesus Gedde, Dexter, MI (US)

(73) Assignees: AGC AUTOMOTIVE AMERICAS R&D, INC., Ypsilanti, MI (US); AGC FLAT GLASS NORTH AMERICA, INC., Alpharetta, GA (US)

( * ) Notice: Subject to any disclaimer, the term of this patent is extended or adjusted under 35 U.S.C. 154(b) by 596 days.

(21) Appl. No.: 14/814,654

(22) Filed: Jul. 31, 2015

(65) Prior Publication Data

US 2017/0033432 A1 Feb. 2, 2017

(51) Int. Cl.
*H01Q 1/12* (2006.01)
*H01Q 1/38* (2006.01)
(Continued)

(52) U.S. Cl.
CPC ..... *H01Q 1/1271* (2013.01); *H01Q 1/38* (2013.01); *H01Q 1/48* (2013.01); *H01Q 5/371* (2015.01); *H01Q 9/045* (2013.01)

(58) Field of Classification Search
CPC ..... H01Q 1/1271; H01Q 1/243; H01Q 1/38; H01Q 1/48; H01Q 5/371; H01Q 9/0407; H01Q 9/045
See application file for complete search history.

(56) References Cited

U.S. PATENT DOCUMENTS 4,286,271 A * 8/1981 Barbano ..... H01Q 13/206 343/792.5
5,220,336 A * 6/1993 Hirotsu ..... H01Q 1/1271 343/713

(Continued)

FOREIGN PATENT DOCUMENTS

EP 0 866 515 A2 9/1998
EP 0 866 515 A3 12/1998
WO WO 2010/129628 A1 11/2010

*Primary Examiner* — Dameon E Levi
*Assistant Examiner* — Ab Salam Alkassim, Jr.
(74) *Attorney, Agent, or Firm* — Howard & Howard Attorneys PLLC

(57) ABSTRACT

An antenna includes a ground element defining a straight edge extending along a first axis. A radiating element is spaced apart from the ground element. A feeding element has a first conductor coupled to the ground element and a second conductor coupled to the radiating element. The radiating element includes two radiating segments extending substantially parallel to one another along a second axis transverse to the first axis with each radiating segment defining a width measured perpendicular to the second axis. The width of one radiating segment is greater than the width of the other radiating segment. A coupling portion connects the radiating segments and includes a straight edge facing the straight edge of the ground element. The straight edge of the coupling portion extends along a third axis that is transverse to the first axis. When combined with a substrate, the antenna is a component of a window assembly.

26 Claims, 9 Drawing Sheets

(51) Int. Cl.

| | |
|---|---|
| ***H01Q 5/371*** | (2015.01) |
| ***H01Q 1/48*** | (2006.01) |
| ***H01Q 9/04*** | (2006.01) |

(56) References Cited

U.S. PATENT DOCUMENTS 5,255,002 A * 10/1993 Day ..... H01Q 1/1271 343/713
5,264,858 A * 11/1993 Shiina ..... H01Q 9/44 343/713
5,353,039 A * 10/1994 Tsukada ..... H01Q 1/1271 343/713
5,406,295 A * 4/1995 Baranski ..... H01Q 1/1271 343/713
5,418,543 A * 5/1995 Bolton ..... H01Q 1/1271 343/713
5,499,034 A * 3/1996 Fujii ..... H01Q 1/1271 343/713
5,521,606 A * 5/1996 Iijima ..... H01Q 1/1271 343/713
5,657,029 A * 8/1997 Iijima ..... H01Q 1/1271 343/713
6,028,557 A * 2/2000 Oka ..... H01Q 1/1271 343/704
6,130,650 A * 10/2000 Curtis ..... H01Q 1/243 343/828
6,292,150 B1 * 9/2001 Doi ..... H01Q 1/1271 343/713
6,337,667 B1 1/2002 Ayala et al.
6,441,791 B1 * 8/2002 Oka ..... H01Q 1/1271 343/713
6,853,341 B1 * 2/2005 Hellgren ..... H01Q 1/3275 343/742
6,864,842 B2 * 3/2005 Hung ..... H01Q 1/38 343/700 MS
6,919,848 B2 * 7/2005 Ishibayashi ..... H01Q 1/1271 343/711
6,943,734 B2 9/2005 Zinanti et al.
7,148,848 B2 12/2006 Colburn et al.
7,187,329 B2 3/2007 Okado
7,315,289 B2 1/2008 Puente Baliarda et al.
7,432,859 B2 * 10/2008 Zinanti ..... H01Q 9/04 343/700 MS
7,471,246 B2 12/2008 Soler Castany et al.
7,501,991 B2 3/2009 Yeap
7,564,423 B2 7/2009 Ke et al.
7,586,452 B2 * 9/2009 Li ..... H01Q 1/1271 343/713
7,742,005 B2 6/2010 Villarroel et al.
7,742,006 B2 * 6/2010 Villarroel ..... H01Q 1/1271 343/713
7,791,546 B2 9/2010 Hotta et al.
7,825,859 B2 11/2010 Teshima
7,843,390 B2 11/2010 Liu
7,859,472 B2 * 12/2010 Tsurume ..... H01Q 1/1271 343/713
D635,964 S 4/2011 Podduturi
7,965,253 B2 6/2011 Lai
8,130,151 B2 3/2012 Tai et al.
8,130,164 B2 3/2012 Semonov et al.
8,305,284 B2 11/2012 Tai et al.
8,502,747 B2 8/2013 Chang et al.
D689,474 S 9/2013 Yang et al.
8,564,489 B2 * 10/2013 Tabata ..... H01Q 1/1278 343/713
9,406,996 B2 * 8/2016 Lee ..... H01Q 1/528
2003/0231139 A1 * 12/2003 Tai ..... H01Q 1/241 343/795
2005/0190108 A1 9/2005 Lin et al.
2005/0264461 A1 * 12/2005 Sugimoto ..... H01Q 1/1271 343/713
2006/0001575 A1 * 1/2006 Jo ..... H01Q 1/243 343/702
2006/0033666 A1 2/2006 Su et al.
2007/0001915 A1 * 1/2007 Kono ..... H01Q 1/1271 343/713
2007/0069964 A1 * 3/2007 Hoshiai ..... H01Q 1/1271 343/713
2007/0091000 A1 * 4/2007 Kim ..... H01Q 1/243 343/700 MS
2007/0097001 A1 * 5/2007 Sugimoto ..... H01Q 1/1271 343/713
2007/0236392 A1 * 10/2007 Lee ..... H01Q 1/2258 343/700 MS
2008/0158074 A1 * 7/2008 Villarroel ..... H01Q 1/1271 343/713
2009/0128419 A1 5/2009 Tseng et al.
2009/0195474 A1 8/2009 Chien et al.
2010/0030211 A1 2/2010 Davalos et al.
2010/0188295 A1 7/2010 Sun
2010/0220031 A1 * 9/2010 Li ..... H01Q 5/35 343/860
2010/0271264 A1 10/2010 Li et al.
2010/0283684 A1 * 11/2010 Rabinovich ..... H01Q 1/3275 343/700 MS
2011/0032155 A1 2/2011 Yanagi et al.
2012/0001815 A1 1/2012 Wong et al.
2012/0038535 A1 * 2/2012 Kotaka ..... H01Q 1/243 343/846
2012/0306709 A1 * 12/2012 Wu ..... H01Q 1/243 343/767
2013/0300631 A1 11/2013 Hsieh
2013/0321212 A1 * 12/2013 O'Shea ..... H01Q 1/38 343/700 MS
2014/0035789 A1 2/2014 Yu et al.

* cited by examiner

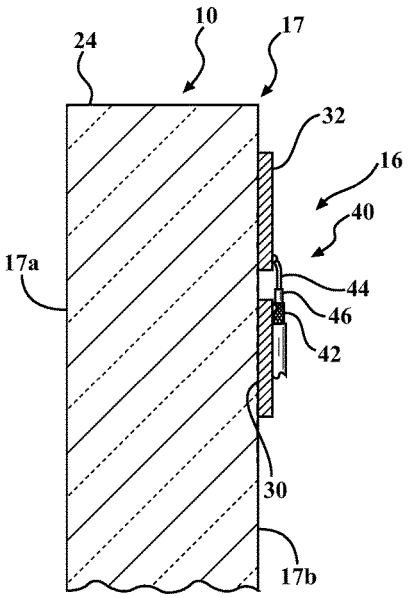
FIG. 2
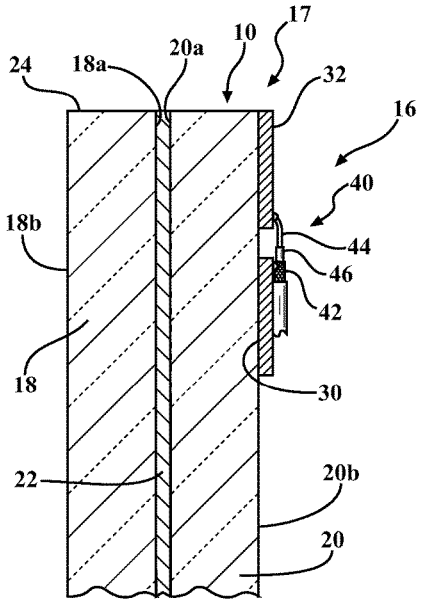
FIG. 3
FIG. 4
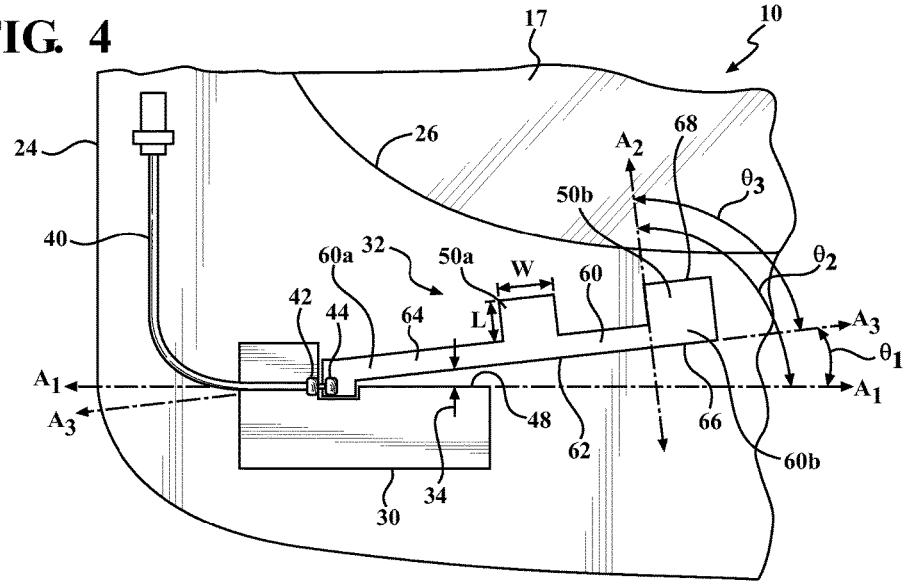

Far Field Gain Pattern at 840 MHz

Far Field Gain Pattern at 1940 MHz

MULTI-BAND ANTENNA FOR A WINDOW ASSEMBLY

BACKGROUND

1. Field of the Invention

The subject invention generally relates to an antenna for a window assembly.

2. Description of the Related Art

Recently, there is increasing demand for vehicles to include telecommunication antennas capable of receiving or transmitting multi-band radio frequencies for applications such as global cellular, industrial, scientific and medical (ISM), and Long-Term Evolution (LTE) applications. Such telecommunication antennas are conventionally bulky and require excessive components, such as specialized housings, printed circuit boards (PCBs), and the like. For these same reasons, such conventional telecommunication antennas cannot be practically implemented on a window assembly. Furthermore, such telecommunication antennas typically are disposed on the roof of the vehicle, thereby making such telecommunication antennas aesthetically unappealing from a vehicle design perspective. Moreover, although some antennas have been implemented on window assemblies, such conventional antennas fail to adequately transmit or receive data over a multi-band spectrum of frequencies.

SUMMARY AND ADVANTAGES

An antenna includes a ground element defining a straight edge extending along a first axis. The antenna includes a radiating element spaced apart from the ground element. The antenna includes a feeding element having a first conductor coupled to the ground element and a second conductor coupled to the radiating element. The radiating element includes two radiating segments extending substantially parallel to one another along a second axis transverse to the first axis. Each radiating segment defines a width measured perpendicular to the second axis. The width of one radiating segment is greater than the width of the other radiating segment. A coupling portion connects the radiating segments and includes a straight edge facing the straight edge of the ground element. The straight edge of the coupling portion extends along a third axis that is transverse to the first axis.

A window assembly includes a substrate defining a surface and an antenna disposed on the surface of the substrate. The antenna includes a ground element defining a straight edge extending along a first axis. The antenna includes a radiating element spaced apart from the ground element. The antenna includes a feeding element having a first conductor coupled to the ground element and a second conductor coupled to the radiating element. The radiating element includes two radiating segments extending substantially parallel to one another along a second axis transverse to the first axis. Each radiating segment defines a width measured perpendicular to the second axis. The width of one radiating segment is greater than the width of the other radiating segment. A coupling portion connects the radiating segments and includes a straight edge facing the straight edge of the ground element. The straight edge of the coupling portion extends along a third axis that is transverse to the first axis.

The antenna and window assembly provide optimized transmission or reception of radio frequency (RF) signals, particularly for LTE, ISM, and global cellular applications.

The antenna has a low profile such that the antenna can be implemented on the window assembly, thereby increasing aesthetics. The radiating segments extend substantially parallel to one another along the second axis to provide multi-band transmission or reception capabilities. The different widths of the radiating segments and the transverse relationship between the first and third axes provide improved impedance matching and tuning capabilities for the antenna. As such, the antenna is robust and versatile and may be configured to suit various telecommunication applications.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 2 is a partial cross-sectional view of one embodiment of the substrate of the window assembly including the antenna disposed thereon.

FIG. 3 is a partial cross-sectional view of another embodiment of the substrate of the window assembly including the antenna disposed thereon.

FIG. 4 is a perspective of the antenna according to one embodiment.

DETAILED DESCRIPTION

Figure 1:
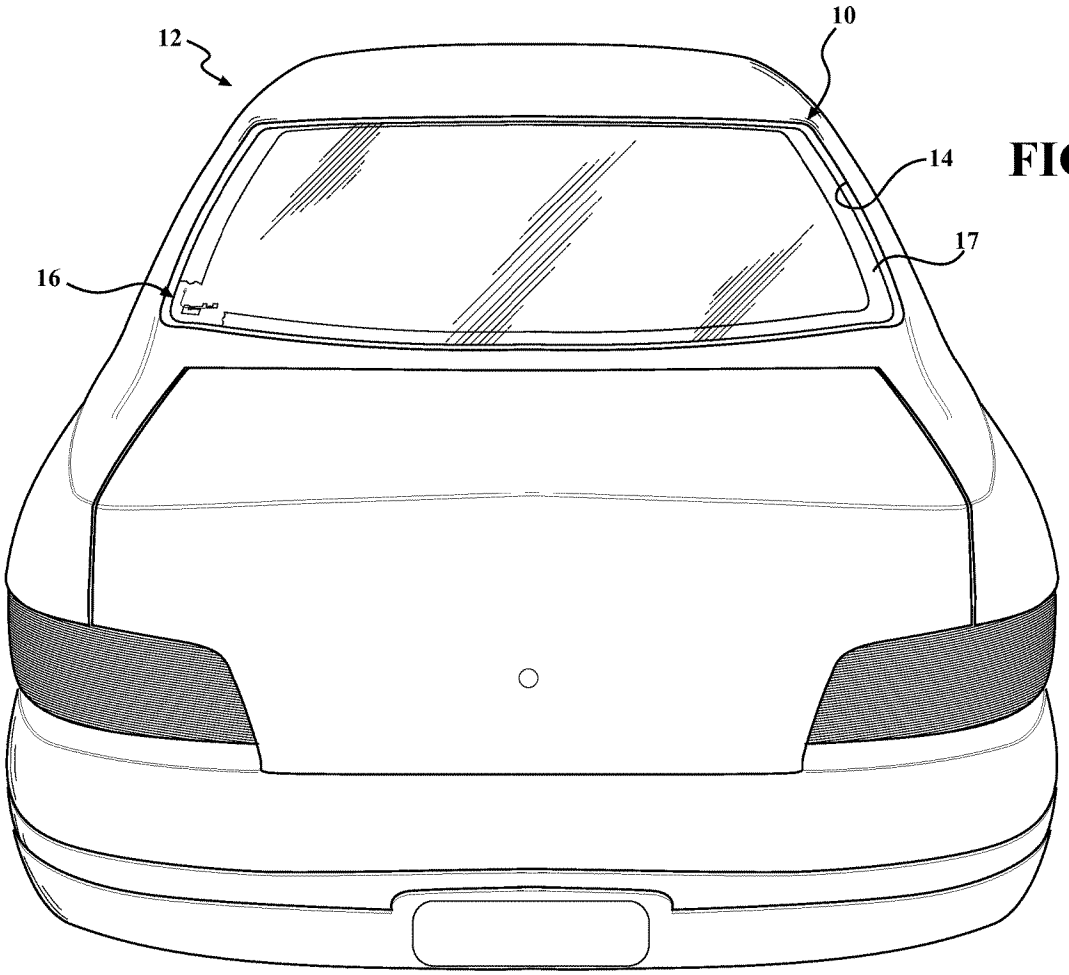
FIG. 1 is a perspective view of a vehicle having a window assembly including a substrate and an antenna disposed on the substrate according to one embodiment.

Referring to the Figures, wherein like numerals indicate corresponding parts throughout the several views, a window assembly is shown generally at 10 in FIG. 1. As shown in FIG. 1, the window assembly 10 is for a vehicle 12. The window assembly 10 may be a rear window (backlite) as illustrated in FIG. 1. Alternatively, the window assembly 10 may be a front window (windshield), a roof window (sunroof), or any other window of the vehicle 12. Typically, the vehicle 12 defines an aperture and the window assembly 10 closes the aperture. The aperture is conventionally defined by a window frame 14 of the vehicle 12, which is typically electrically conductive. Utilizing the antenna 16 with the window assembly 10 provides communication capabilities to various electronic systems of the vehicle 12.

Alternatively, the window assembly 10 may be for applications other than for vehicles 12. For example, the window assembly 10 may be for aircrafts or architectural applications such as homes, buildings, and the like.

As shown throughout the Figures, the window assembly 10 includes an antenna 16. As will be described in detail below, the antenna 16 is configured to transmit RF signals. Alternatively or additionally, the antenna 16 is configured to receive RF signals. The antenna 16 is capable of transmitting and receiving RF signals over a wide range (multi-band) of frequencies. For example, the antenna 16 is capable of transmitting and receiving RF signals in a range between 600 MHz and 6 GHz. The antenna 16 is configured for transmitting and receiving RF signals for global cellular, LTE, and ISM radio band applications. Various details about the geometry, components, and characteristics of the antenna 16 are provided below.

As shown in the Figures, the antenna 16 is planar or substantially planar. In other words, the antenna 16 exhibits a substantially flat configuration or low profile such that the antenna 16 substantially lies in a plane, e.g., any surface of the substrate 17. By being planar or substantially planar, the antenna 16 occupies minimal space and is easily concealable to occupants of the vehicle 12. The antenna 16 may be placed easily on any surface of the substrate 17 or within the substrate 17. Of course, the antenna 16 may not be absolutely flat. Instead, the antenna 16 may be planar enough for easy installation on or within the window assembly 10. In one example, the antenna 16 is planar such that the antenna 16 has a thickness greater than 0 mm and less than 3 mm.

The window assembly 10 may include one antenna 16 or a plurality of the antennas 16. Any of the plurality of antennas 16 may have any suitable configuration as described herein. The plurality of antennas 16 may have similar or different configurations.

As shown throughout FIGS. 1-8, the window assembly 10 includes a substrate 17. In one embodiment, the substrate 17 is a pane of glass. The pane of glass is preferably automotive glass and, more preferably, soda-lime-silica glass. The substrate 17 is electrically non-conductive. In one embodiment, the term "non-conductive" refers generally to a material, such as an insulator or dielectric, that when placed between conductors at different electric potentials, permits no or a negligible current to flow through the material.

The substrate 17 is also substantially transparent to light. However, the substrate 17 may be colored or tinted and still be substantially transparent to light. In one embodiment, the term "substantially transparent" is defined as having a visible light transmittance of greater than sixty percent. In other embodiments, the substrate 17 may be plastic, fiberglass, or other suitable electrically non-conductive and substantially transparent material. For automotive applications, the substrate 17 may have any suitable thickness, such as between 4-7 mm thick.

In one embodiment, as shown in FIG. 2, the window assembly 10 includes a single substrate 17 having an exterior surface 17*a* and an interior surface 17*b*. When installed, the exterior surface 17*a* faces an exterior of the vehicle 12 and the interior surface 17*b* faces an interior of the vehicle 12.

Alternatively, as shown in FIG. 3, the window assembly 10 may include an exterior substrate 18 and an interior substrate 20 disposed adjacent the exterior substrate 18. Here, the window assembly 10 is formed by a combination of the exterior and interior substrates 18, 20. In other words, the exterior and interior substrates 18, 20 are preferably joined together to form the window assembly 10.

When installed, the exterior substrate 18 is disposed adjacent the exterior of the vehicle 12 and the interior substrate 20 is disposed adjacent the interior of the vehicle 12. The exterior substrate 18 may be spaced from the interior substrate 20 such that the substrates 18, 20 are not contacting one another. Alternatively, the exterior substrate 18 may directly abut the interior substrate 20.

Each of the exterior and interior substrates 18, 20 has an inner surface 18*a*, 20*a* and an outer surface 18*b*, 20*b*. When installed, the outer surface 18*b* of the exterior substrate 18 faces the exterior of the vehicle 12 and the outer surface 20*b* of the interior substrate 20 faces an interior of the vehicle 12. The inner surfaces 18*a*, 20*a* of the exterior and interior substrates 18, 20 face one another when the exterior and interior substrates 18, 20 are joined together to form the window assembly 10.

Although not required, an interlayer 22, as shown in FIG. 3, may be disposed between the inner surfaces 18*a*, 20*a* of the exterior and interior substrates 18, 20. The interlayer 22 bonds the exterior and interior substrates 18, 20 and prevents the window assembly 10 from shattering upon impact. The interlayer 22 is substantially transparent to light and typically includes a polymer or thermoplastic resin, such as polyvinyl butyral (PVB). Other suitable materials for implementing the interlayer 22 may be used. In one embodiment, the interlayer 22 has a thickness of between 0.5 mm to 1 mm. Those skilled in the art appreciate that the substrate 17 may have various other configurations other than those specifically recited herein.

As best shown in FIGS. 2 and 3, the antenna 16 is disposed on the substrate 17. As shown in FIG. 2, the antenna 16 may be disposed on the interior surface 17*b* of the substrate 17. The antenna 16 may be disposed on the interior surface 17*b* of the substrate 17 to shelter the antenna 16 from environmental conditions exterior to the vehicle 12. Alternatively, antenna 16 may be disposed on the exterior surface 17*a* of the substrate 17.

When the window assembly 10 includes the exterior and interior substrates 18, 20, the antenna 16 may be disposed on the outer surface 20*b* of the interior substrate 20, as shown in FIG. 3. Again, the antenna 16 may be disposed on the outer surface 20*b* of the interior substrate 20 to shelter the antenna 16 from environmental conditions exterior to the vehicle 12. Alternatively, the antenna 16 may be disposed between the exterior and interior substrates 18, 20. More specifically, the antenna 16 may be disposed between the interlayer 22 and the inner surface 18*a* of the exterior substrate 18. In yet another embodiment, the antenna 16 is disposed between the interlayer 22 and the inner surface 20*a* of the interior substrate 20.

As shown in FIGS. 1-8, the antenna 16 may be disposed adjacent a peripheral edge 24 of the window assembly 10. In one example, as shown in FIG. 2, the antenna 16 is disposed near the peripheral edge 24 but spaced slightly from the peripheral edge 24. Alternatively, as shown in FIG. 3, the antenna 16 may be disposed against the peripheral edge 24 such that the antenna 16 is directly at the peripheral edge 24. Disposing the antenna 16 as such helps to conceal the antenna 16 after the window assembly 10 is installed. Concealing the antenna 16 provides greater aesthetic appeal and minimized obstruction to the field of view for occupants of the vehicle 12.

A concealing layer 26, as demarcated in FIGS. 4-8, may be disposed on the substrate 17 for concealing the antenna 16. In one embodiment, the concealing layer 26 is formed of a ceramic print 62. The concealing layer 26 is typically applied to one of the interior and exterior substrates 18, 20. The concealing layer 26 may be disposed on the same or a different surface of the substrate 17 as the antenna 16. As shown in the Figures, the concealing layer 26 extends from the peripheral edge 24 of the window assembly 10. The concealing layer 26 may have any appropriate thickness. The concealing layer 26 conceals the antenna 16 and the feeding element 40 for an aesthetically appealing configuration. The antenna 16 may also be concealed by vehicle trim, which is installed along the window frame 14.

In FIGS. 1-8, the antenna 16 is disposed within the peripheral edge 24. In other words, the antenna 16 does not physically extend beyond the peripheral edge 24. Of course, as described below, electrical connections to the antenna 16 may extend past the peripheral edge 24 to reach external components of the vehicle 12, such as communication systems, radios, amplifiers, or the like.

In one embodiment, the antenna 16 is substantially opaque to light such that light cannot pass through the antenna 16. Opaqueness may result from the compositional nature of the antenna 16. Alternatively, the antenna 16 may be translucent or transparent. Translucence or transparency of the antenna 16 may be important in situations, for example, where portions or the entirety of the antenna 16 may be exposed within the field of view of occupants of the vehicle 12 after installation of the window assembly 10.

Various embodiments of the antenna 16 are shown throughout FIGS. 4-8. As illustrated in each embodiment, the antenna 16 includes a ground element 30 and a radiating element 32. The ground element 30 is spaced apart from the radiating element 32. That is, the ground element 30 does not directly touch or abut the radiating element 32. The ground element 30 is spaced from the radiating element 32 by a first gap 34. The first gap 34 is defined between the ground element 30 and the radiating element 32. In one embodiment, the non-conductive substrate 17 is exposed across the first gap 34. The ground element 30 must be spaced apart from the radiating element 32 to facilitate capacitive coupling between the ground and radiating elements 30, 32 for proper operation of the antenna 16. Of course, those skilled in the art appreciate that the ground element 30 may be indirectly connected to the radiating element 32 via feeding connections, as is described in detail below.

The antenna 16, and more specifically, the ground and radiating elements 30, 32 are electrically conductive. The ground and radiating elements 30, 32 may be formed of any suitable conductor. In one example, the ground and radiating elements 30, 32 comprise an electrically conductive paste, such as a copper or silver paste. In another example, the ground and radiating elements 30, 32 comprise a conductive adhesive, such as a copper tape. In yet another example, the ground and radiating elements 30, 32 comprise metal segments.

The ground and radiating elements 30, 32 may be applied to the window assembly 10 according to any suitable method, such as printing, firing, adhesion and the like. Moreover, the ground and radiating elements 30, 32 may be supported directly by the substrate 17. In other words, the ground and radiating elements 30, 32 may each stand-alone without requiring specialized structurally supporting components or housings. For example, the ground and radiating elements 30, 32 may be disposed directly onto the substrate 17 without otherwise requiring a printed circuit board (PCB) or the like.

In one embodiment, the ground and radiating elements 30, 32 are integrally formed from a common material and then separated. Alternatively, the ground and radiating elements 30, 32 may be formed of separate materials or separately formed.

Electrical current is readily transferrable through the ground and radiating elements 30, 32 as the antenna 16 is energized. Of course, the antenna 16 need not be energized in order for the ground and radiating elements 30, 32 to be electrically conductive. That is, the ground and radiating elements 30, 32 are intrinsically conductive in an unenergized state by virtue of the conductive material from which they are comprised.

The ground and radiating elements 30, 32 each define a surface area. The surface area is defined within a geometric perimeter of each of the ground and radiating elements 30, 32. As such, the surface area of the ground and radiating elements 30, 32 are finite (and not infinite or theoretical).

In one embodiment, the surface area of the ground element 30 is greater than the surface area of the radiating element 32. In one example, the surface area of the ground element 30 is greater than 1000 $mm^2$ and less than 2500 $mm^2$ and the surface area of the radiating element 32 is greater than 500 $mm^2$ and less than 1500 $mm^2$. For instance, in FIG. 4, the surface area of the ground element 30 is approximately 2164 $mm^2$ and the surface area of the radiating element 32 is approximately 1367 $mm^2$. In another example, the surface areas of the ground element 30 and radiating element 32 are each greater than 500 $mm^2$ and less than 1000 $mm^2$. For instance, in FIG. 5, the surface area of the ground element 30 is approximately 900 $mm^2$ and the surface area of the radiating element 32 is approximately 715 $mm^2$.

Alternatively, the surface area of the ground element 30 may be less than the surface area of the radiating element 32. Those skilled in the art appreciate that the ground and radiating elements 30, 32 may have surface areas of any suitable size depending on the particular application.

As shown throughout the FIGS. 1-9, the window assembly 10 includes a feeding element 40 for energizing the antenna 16. The feeding element 40 is coupled to the antenna 16, and more specifically, to the ground element 30 and radiating element 32. The feeding element 40 is configured to energize the antenna 16, and more specifically, the ground and radiating elements 30, 32 such that the ground and radiating elements 30, 32 transmit or receive RF signals. The feeding element 40 is electrically coupled to the ground and radiating elements 30, 32 such that the ground and radiating elements 30, 32 operate as active (rather than passive) antenna elements for excitation or reception of RF waves.

The feeding element 40 has a first conductor 42 coupled to the ground element 30 and a second conductor 44 coupled to the radiating element 32. In one embodiment, as best shown in FIGS. 2 and 4, the feeding element 40 is a coaxial line. More specifically, the first conductor 42 may be a braided conductor and the second conductor 44 may be core wire surrounded by the first conductor 42. An insulating member 46 may be disposed between the first and second conductors 42, 44 to prevent interference between the first and second conductors 42, 44.

The feeding element 40 is coupled to a power source, and more specifically a source of RF energy, such as an RF amplifier. The first conductor 42 is coupled to electrical ground, such as amplifier ground, vehicle ground or window frame ground. The second conductor 44 is coupled to the source of RF energy such that electromagnetic energy is propagated though the second conductor 44.

In other embodiments, the feeding element 40 may include a feeding strip, a feeding wire, or a combination of both. In addition, the feeding element 40 may be a balanced or unbalanced line. For example, the feeding element 40 may be an unbalanced coaxial cable, microstrip, or single wire line. The feeding element 40 may include any suitable material and have any suitable configuration for energizing the antenna 16.

Furthermore, the feeding element 40 connect to any suitable feeding network for controlling RF signals transmitted or received by the antenna 16. As shown in FIGS. 1-8, the feeding element 40 may couple to the each of the ground and radiating elements 30, 32 at one feed point. Alternatively, the feeding element 40 may couple to the each of the ground and radiating elements 30, 32 at a plurality of feed points.

Figure 5:
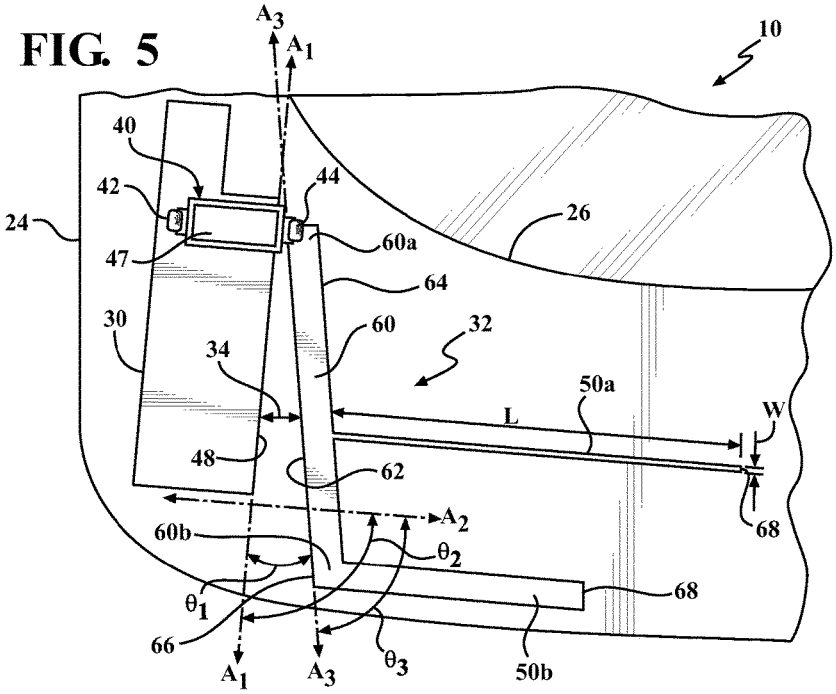
FIG. 5 is a perspective of the antenna according to another embodiment.
Figure 6:
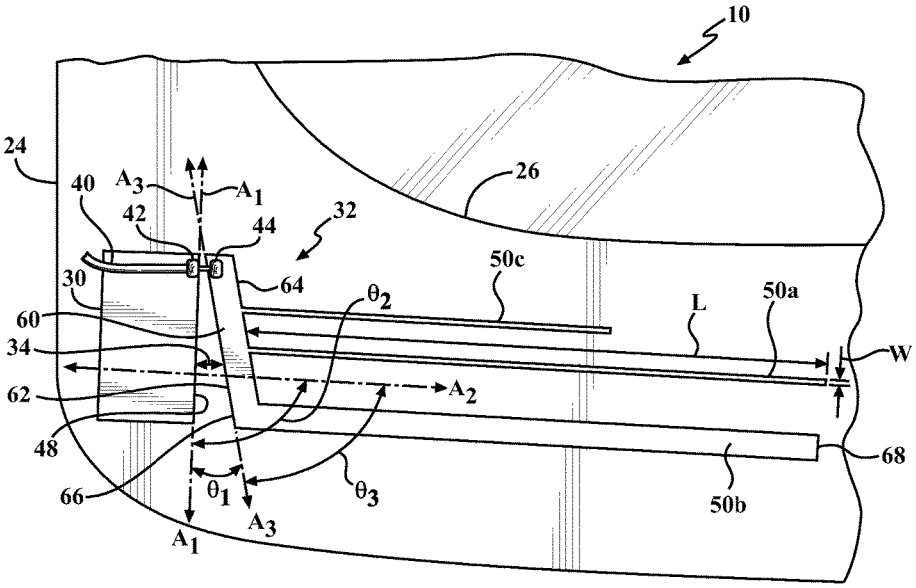
FIG. 6 is a perspective of the antenna according to another embodiment.
Figure 7:
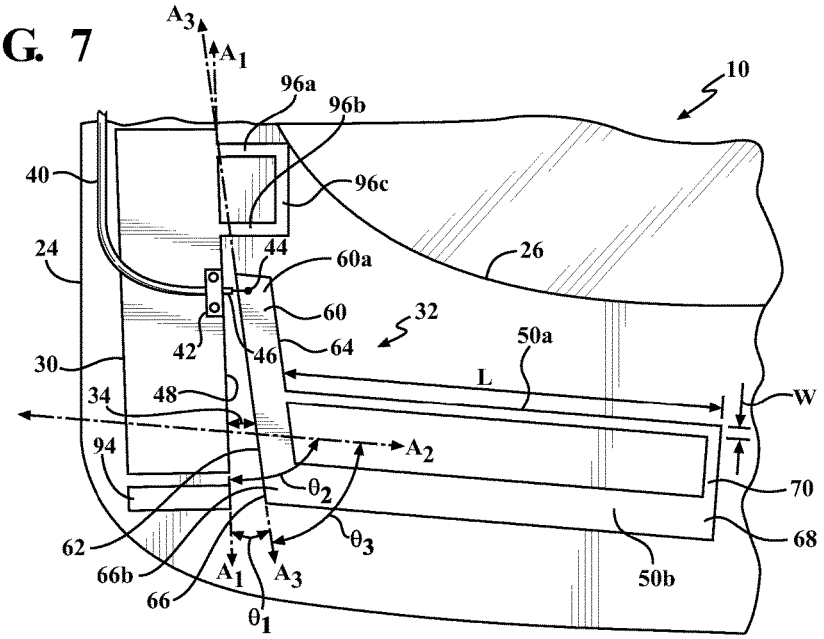
FIG. 7 is a perspective of the antenna according to another embodiment.

According to one embodiment, as shown in FIGS. 2-9, the feeding element 40 is abutting and in direct electrical connection with the antenna 16. Here, the feeding element 40 passes electrical current to the antenna 16 directly through an electrically conductive material, such as a feeding strip or wire, physically attached to the antenna 16. For example, as shown in FIGS. 4, 6, 8, and 9, the feeding element 40 may be directly wired or soldered to the antenna 16. In another embodiment, as shown in FIG. 5, the feeding element 40 interfaces with a connector 47 that is electrically connected to the ground and radiating elements 30, 32. As shown in FIG. 7, the feeding element 40 may be retained by a retention mechanism, such as a terminal or crimp. The retention mechanism may be mechanically and electrically connected to the ground element 30, radiating element 32, or both.

In other embodiments, the feeding element 40 is spaced from and capacitively coupled to the antenna 16. In such instances, the feeding element 40 induces electrical current to the antenna 16 through the air or a dielectric material, such as the exterior or interior substrates 18, 20 and/or interlayer 22. When capacitively coupled, the feeding element 40 is neither hard-wired nor in direct contact with the antenna 16 and is disposed non-coplanar with the antenna 16. For instance, the feeding element 40 may be disposed on the outer surface 20*b* of the interior substrate 20 and capacitively coupled to the antenna 16 disposed between the interlayer 22 and the inner surface 20*a* of the interior substrate 20. The feeding element 40 may be spaced from and capacitively coupled to the antenna 16 on the window assembly 10 according to several other embodiments not specifically described herein.

The feeding element 40 may be positioned with respect to the window assembly 10 and the antenna 16 according to various other configurations. For example, as shown in FIGS. 2 and 3, the feeding element 40 may be disposed directly on the exterior or interior surface 17*a*, 17*b* of the substrate 17. Alternatively, the feeding element 40 may be disposed between the exterior and interior substrates 18, 20. The feeding element 40 may be connected to electrical wires or connectors extending along the peripheral edge 24 of the window assembly 10 such that the electrical wires or connectors are concealed from occupants of the vehicle 12.

In one embodiment, the antenna 16 may be integrated as a single component. The single component, including the ground element 30, radiating element 32, and feeding element 40 may be readily removed and attached to the window assembly 10. The single component may have a substantially planar configuration such that the single component may be easily sandwiched between the interior and exterior substrates 18, 20. The single component may include a mating connector for connecting to the corresponding electrical system, such as the electrical system of the vehicle 12, and the like.

As illustrated in FIGS. 4-9, the ground element 30 defines a straight edge 48. The straight edge 48 extends along a first axis A1. In the Figures, the straight edge 48 appears absolutely straight. However, those skilled in the art appreciate that the straight edge 48 may not be absolutely straight due to practical limitations, and the like. That is, certain portions of the straight edge 48 may include imperfections, notches, indentations, and the like. As such, the straight edge 48 need be only straight such that a substantial majority of the straight edge 48 visibly extends along the first axis A1 when observed by the human eye. In one embodiment, greater than 90% of the straight edge 48 visibly extends along the first axis A1. In another embodiment, greater than 95% of the straight edge 48 visibly extends along the first axis A1. In yet another embodiment, greater than 99% of the straight edge 48 visibly extends along the first axis A1.

Of course, the first axis A1, as shown in the Figures, is provided as a mathematical tool for geometrically referencing orientation of the straight edge 48. In reality, the first axis A1 may not be visible or exist. However, the first axis A1 may be easily discerned by aligning another straight edge, such as a ruler, with the straight edge 48 and demarcating the first axis A1 by drawing a line along the straight edge of the ruler.

As shown in FIGS. 4-9, the radiating element 32 includes two radiating segments 50*a*, 50*b*. The two radiating segments 50*a*, 50*b* extend substantially parallel to one another along a second axis A2. The second axis A2 extends transverse to the first axis A1. That is, the second axis A2 is non-parallel with the first axis A1 such that the second axis A2 eventually intersects the first axis A1 as shown in the Figures.

As with the first axis A1, the second axis A2 may be easily discerned by aligning a straight edge, such as a ruler, in parallel with the two radiating segments 50*a*, 50*b* and demarcating the second axis A2 by drawing a line along the straight edge of the ruler.

The antenna includes the two radiating segments 50*a*, 50*b* to provide the antenna 16 with multi-band behavior. That is, each radiating segment 50*a*, 50*b* is configured by virtue of its geometry to capture a desire frequency or range of frequencies during transmission or reception. Since there are two radiating segments 50*a*, 50*b*, the range of frequencies, when combined, collectively cover a broad range of frequencies, as illustrated in results described below.

In some embodiments, such as is shown in FIG. 6, the antenna 16 may include more than the two radiating segments 50*a*, 50*b*. For example, in FIG. 6, the antenna 16 includes a third radiating segment 50*c*. The third radiating segment 50*c* extends substantially parallel to the other two radiating segments 50*a*, 50*b* along the second axis A2. Each additional radiating segment 50 beyond the two radiating segments 50*a*, 50*b* may provide additional or more balanced frequency range coverage. However, additional radiating segments 50 may influence performance of the two radiating segments 50*a*, 50*b*, which may be tuned to emphasize a particular desired frequency range for certain applications.

Those skilled in the art appreciate that the antenna 16 may include any suitable number of additional radiating segments 50 beyond the two radiating segments 50*a*, 50*b* and that such additional radiating segments 50 may have any suitable configuration within the scope of the invention.

Each radiating segment 50*a*, 50*b* defines a width "W" measured perpendicular to the second axis A2. For simplicity in illustration, the width of only one radiating segment 50*a* is illustrated. Of course, the width of the other radiating segment 50*b* is measured in a similar manner.

The width of one radiating segment 50*a*, 50*b* is greater than the width of the other radiating segment 50*a*, 50*b*. The width of one radiating segment 50*a*, 50*b* may be "N" times greater than the width of the other radiating segment 50*a*, 50*b*. In one embodiment, the width of each radiating segment 50*a*, 50*b* is greater than 0 mm and less than 10 mm. For instance, as shown in FIG. 5, the width of radiating segment 50*a* is 1 mm and the width of radiating segment 50*b* is 6 mm. As such, in FIG. 5, the width of radiating segment 50*a* is six times greater than the width of radiating segment 50*b*. In another embodiment, the width of each radiating segment 50*a*, 50*b* is greater than 15 mm and less than 25 mm. For example, as shown in FIG. 4, the width of radiating segment 50*a* is approximately 16.8 mm and the width of radiating segment 50*b* is approximately 20.6 mm. As such, in FIG. 4, the width of radiating segment 50*a* is approximately 80% of the width of radiating segment 50*b*. Those skilled in the art appreciate that each radiating segment 50*a*, 50*b* may have any suitable width not specifically described herein.

The widths of the radiating segments 50*a*, 50*b* are different from one another to provide the antenna 16 with improved impedance matching and tuning capabilities. Thus, the widths of the radiating segments 50*a*, 50*b* may be adjusted according to the specific application or transmission/reception frequency desired. In one example, as the width of the radiating segment 50 increases, the desired frequency decreases, and vice-versa.

In one embodiment, the widths of the radiating segments 50*a*, 50*b* define a reactance value (i.e., an imaginary part of impedance that is related to the inductance/capacitance) of the radiating segments 50*a*, 50*b*. The inductance/capacitance values are closely related to the bandwidth, impedance matching and tuning capabilities of the antenna 16. For example, the capacitance value of each radiating segment 50*a*, 50*b* increases as the width of each radiating segment 50*a*, 50*b* increases. Similarly, the capacitance value of each radiating segment 50*a*, 50*b* decreases as the width of each radiating segment 50*a*, 50*b* decreases. On the other hand, the inductance value of each radiating segment 50*a*, 50*b* decreases as the width of each radiating segment 50*a*, 50*b* increases. The inductance value of each radiating segment 50*a*, 50*b* increases as the width of each radiating segment 50*a*, 50*b* decreases. The radiating segments 50*a*, 50*b* are different widths because of the tuning process, which takes into consideration bandwidth, impedance matching, and other constraints such as the aesthetics of the antenna 16, manufacturability, and the like.

Each radiating segment 50*a*, 50*b* further defines a length "L" measured parallel to the second axis A2. For simplicity in illustration, the length of only one radiating segment 50*a* is illustrated. Of course, the length of the other radiating segment 50*b* is measured in a similar manner.

In one embodiment, as shown in FIG. 4, for example, the length of one radiating segment 50*a* is substantially equal to the length of the other radiating segment 50*b*. Alternatively, as shown in FIG. 5, for example, the length of one radiating segment 50*a*, 50*b* is greater than the length of the other radiating segment 50*a*, 50*b*.

In one embodiment, the length of each radiating segment 50*a*, 50*b* is greater than 0 mm and less than 15 mm. For instance, as shown in FIG. 4, the length of each of the radiating segments 50*a*, 50*b* is approximately 12 mm. In another embodiment, the length of each radiating segment 50*a*, 50*b* is greater than 40 mm and less than 100 mm. Additionally, the length of one radiating segment 50*a*, 50*b* may be "N" times greater than the length of the other radiating segment 50*a*, 50*b*. For example, as shown in FIG. 5, the length of radiating segment 50*a* is approximately 93 mm and the length of radiating segment 50*b* is approximately 43 mm such that the length radiating segment 50*a* is over twice as great as the length of radiating segment 50*b*. Those skilled in the art appreciate that each radiating segment 50*a*, 50*b* may be configured to have any suitable length not specifically described herein.

The radiating segments 50*a*, 50*b* may be different lengths because of the tuning process, which takes into consideration bandwidth, impedance matching, and other constraints such as the aesthetics of the antenna 16, manufacturability, and the like.

The lengths of the radiating segments 50*a*, 50*b* may be configured to provide the antenna 16 with improved impedance matching and tuning capabilities. Thus, the lengths of the radiating segments 50*a*, 50*b* may be adjusted according to the specific application or transmission/reception frequency desired. The lengths of the radiating segments 50*a*, 50*b* influence the operating frequency of the antenna 16. In one example, as the length of the radiating segment 50 increases, the desired frequency deceases, and vice-versa. Longer lengths of the radiating segments 50*a*, 50*b* shift operating frequency toward a lower frequency. Shorter lengths of the radiating segments 50*a*, 50*b* shift operating frequency toward a higher frequency.

In some embodiments, as shown in FIG. 4, the width of each radiating segment 50*a*, 50*b* is greater than the length of each radiating segment 50*a*, 50*b*. That is, each radiating segment 50*a*, 50*b* is wider than it is long. Alternatively, as shown in FIGS. 5-8, the length of each radiating segment 50*a*, 50*b* is greater than the width of each radiating segment 50*a*, 50*b*. That is, each radiating segment 50*a*, 50*b* is longer than it is wide.

As described above, the radiating segments 50*a*, 50*b* operate to capture the desired frequencies for transmission or reception by the antenna 16. The lengths, widths, and positioning of the radiating segment 50*a*, 50*b* may influence which frequencies are transmitted or received.

The radiating segments 50*a*, 50*b* may further operate to provide impedance matching by matching impedance of the antenna 16 to an impedance of a cable or circuit. The cable, for example, may be a cable, such as a coaxial cable, that is connected to the feeding element 40 that energizes the antenna 16. The circuit may be, for example, an amplifier or other circuit connected to the antenna 16 through a cable or lead wire. The lengths, widths, and positioning of the radiating segment 50*a*, 50*b* may influence the impedance of the antenna 16 for matching purposes.

The radiating segments 50*a*, 50*b* may further operate to alter radiation patterns by altering directions by which radio signals are transmitted or received by the antenna 16. More specifically, the radiating segments 50*a*, 50*b* may alter directions by which radio signals are transmitted or received such that the radiation pattern(s) exhibit greater omnidirectionality. The lengths, widths, and positioning of the radiating segment 50*a*, 50*b* may have affect how the radiating patterns are altered.

At higher frequencies, one of the radiating segments 50*a*, 50*b* may have an emphasized role in radiation pattern alternation as compared with the other one of the radiating segments 50*a*, 50*b*. At lower frequencies, one of the radiating segments 50*a*, 50*b* may have an emphasized role in impedance matching as compared with the other one of the radiating segments 50*a*, 50*b*. For example, for the antenna 16 in FIG. 5, radiating segment 50*b* has greater impact on impedance matching for lower frequencies as compared to radiating segment 50*a*.

As shown in FIGS. 4-9, a coupling portion 60 connects the radiating segments 50*a*, 50*b*. Each radiating segment

50*a*, 50*b* connects to the coupling portion 60. As such, the radiating element 32 is comprised of a combination of the radiating segments 50*a*, 50*b* and the coupling portion 60. As with the radiating segments 50*a*, 50*b*, the coupling portion is electrically conductive.

The coupling portion 60 includes a straight edge 62 facing the straight edge 48 of the ground element 30. The straight edge 62 of the coupling portion 60 extends along a third axis A3 that is transverse to the first axis A1. In other words, the straight edge 62 of the coupling portion 60 is transverse to the straight edge 48 of the ground element 30. The third axis A3 is non-parallel with the first axis A1 such that the third axis A3 eventually intersects the first axis A1, as shown in the Figures.

Similar to the straight edge 48 of the ground element 30, the straight edge 62 of the coupling portion 60 appears absolutely straight in the Figures. However, those skilled in the art appreciate that the straight edge 62 may not be absolutely straight due to practical limitations, and the like. That is, certain portions of the straight edge 62 may include imperfections, notches, indentations, and the like. As such, the straight edge 62 need be only straight such that a substantial majority of the straight edge 62 visibly extends along the third axis A3 when observed by the human eye. In one embodiment, greater than 95% of the straight edge 62 visibly extends along the third axis A3. In another embodiment, greater than 99% of the straight edge 62 visibly extends along the third axis A3.

Of course, the third axis A3, as shown in the Figures, is provided as a tool for geometrically referencing orientation of the straight edge 62. In reality, the third axis A3 may not be visible. However, the third axis A3 may be easily discerned by aligning a straight edge, such as a ruler, with the straight edge 62 of the coupling portion 60 and demarcating the third axis A3 by drawing a line along the straight edge of the ruler.

The transverse relationship between the first and third axes A1, A3, and effectively, the transverse relationship between the straight edge 62 of the coupling portion 60 and the straight edge 48 of the ground element 30 is important to antenna functionality. The transverse relationship may help tune the antenna 16 to capture desired frequencies for transmission or reception by the antenna 16. Having the third axis A3 transverse to the first axis A1 may also help provide impedance matching for the antenna 16 and help to alter directions by which radio signals are transmitted or received by the antenna 16. The transverse relationship may provide the antenna 16 with unique geometrical configurations. These geometrical configurations may enable, for example, the antenna 16 to be disposed in certain areas of the window assembly 10 not previously possible.

Respective geometric relationships between the first axis A1, second axis A2, and third axis A3, are illustrated throughout FIGS. 4-8. As shown, a first angle $\theta_1$ is defined between the first axis A1 and the third axis A3. More specifically, the first angle $\theta_1$ is defined between the straight edge 48 of the ground element 30 and the straight edge 62 of the coupling portion 60. A second angle $\theta_2$ is defined between the first axis A1 and the second axis A2. More specifically, the second angle $\theta_2$ is defines the relationship between the straight edge 48 of the ground element 30 and the orientation of the radiating segments 50*a*, 50*b*. A third angle $\theta_3$ is defined between the second axis A2 and the third axis A3. More specifically, the third angle $\theta_3$ defines the relationship between the straight edge 62 of the coupling portion 60 and the orientation of the radiating segments 50*a*, 50*b*.

Figure 8:
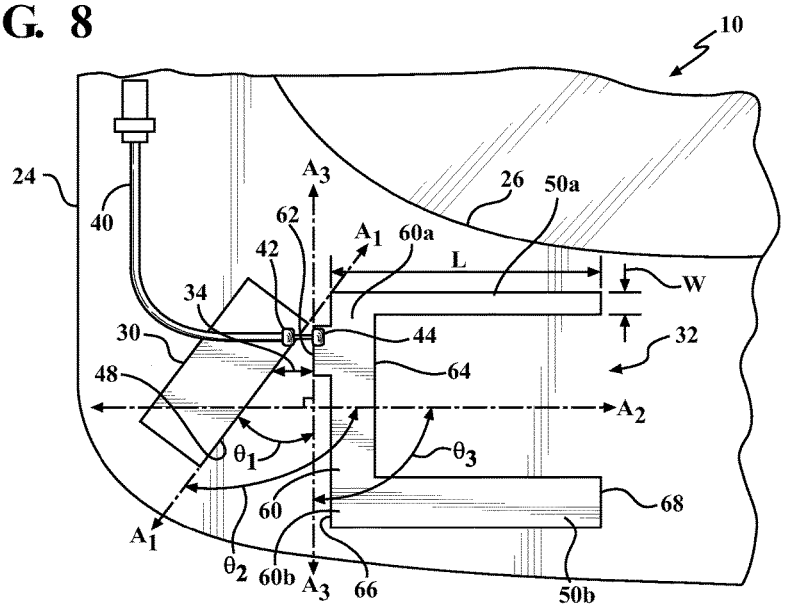
FIG. 8 is a perspective of the antenna according to yet another embodiment.

In one embodiment, the first angle $\theta_1$ is greater than 3 degrees and less than 45 degrees. For example, the first angle $\theta_1$ in FIG. 8 is approximately 35 degrees. In another embodiment, the first angle $\theta_1$ is greater than 5 degrees and less than 15 degrees. For example, the first angle $\theta_1$ in FIG. 4 is approximately 8 degrees, the first angle $\theta_1$ in FIG. 7 is approximately 9 degrees, and the first angle $\theta_1$ in FIG. 5 is approximately 10 degrees. Generally, the first angle $\theta_1$ cannot be at angles causing either of the second axis A2 or third axis A3 to become parallel (no longer transverse) with the first axis A1.

Performance of the antenna 16 is influenced by the transverse relationship between the straight edge 62 of the coupling portion 60 and the straight edge 48 of the ground element 30. The size of the first angle $\theta_1$ influences capacitive coupling between the straight edge 62 of the coupling portion 60 and the straight edge 48 of the ground element 30. Mainly, as the size of the first angle $\theta_1$ increases, operating frequency of the antenna 16 shift from lower frequencies toward higher frequencies.

The size of the first angle $\theta_1$ may have also an influence on which frequencies are transmitted or received by the antenna 16, radiation pattern characteristics of the antenna 16, impedance matching properties of the antenna 16, and the geometrical shape of the antenna 16.

In one embodiment, the second angle $\theta_2$ is greater than 45 degrees and less than 135 degrees. For example, the second angle $\theta_2$ in FIG. 8 is approximately 127 degrees. In another embodiment, the second angle $\theta_2$ is greater than 80 degrees and less than 100 degrees. For example, the second angle $\theta_2$ in FIG. 7 is approximately 81 degrees, the second angle $\theta_2$ in FIG. 4 is approximately 95 degrees, and the second angle $\theta_2$ in each of FIGS. 5 and 6 is approximately 90 degrees. In FIGS. 5 and 6, the second angle $\theta_2$ is 90 degrees such that the radiating segments 50*a*, 50*b* extend substantially perpendicular with respect to the straight edge 48 of the ground element 30.

The size of the second angle $\theta_2$ may have an influence on which frequencies are transmitted or received by the antenna 16, radiation pattern characteristics of the antenna 16, impedance matching properties of the antenna 16, and the geometrical shape of the antenna 16.

In one embodiment, the third angle $\theta_3$ is greater than 75 degrees and less than 100 degrees. For example, the third angle $\theta_3$ in FIG. 6 is approximately 75 degrees, the third angle $\theta_3$ in FIG. 7 is approximately 78 degrees, and the third angle $\theta_3$ in each of FIG. 7 is approximately 78 degrees. In other embodiments, the third angle $\theta_3$ is approximately 90 degrees such that the radiating segments 50*a*, 50*b* extend substantially perpendicular with respect to the straight edge 62 of the coupling portion 60.

The size of the third angle $\theta_3$ may have an influence on which frequencies are transmitted or received by the antenna 16, radiation pattern characteristics of the antenna 16, impedance matching properties of the antenna 16, and the geometrical shape of the antenna 16.

As shown in FIGS. 4-9, the first gap 34 is more specifically defined between the straight edge 48 of the ground element 30 and the straight edge 62 of the coupling portion 60. The first gap 34 has a width that varies between the straight edges 48, 62 because the third axis A3 is transverse to the first axis A1.

In some embodiments, the feeding element 40 extends across the first gap 34. More specifically, as shown in FIGS. 5-8, the first conductor 42 of the feeding element 40 may be connected adjacent, or substantially proximal to, the straight edge 48 of the ground element 30. The second conductor 44 may be connected adjacent, or substantially proximal to, the straight edge 62 of the coupling portion 60. Disposing the first and second conductors 42, 44 adjacent the straight edges 48, 62 may improve antenna performance and ease of assembly. The feeding element 40 may extend across the first gap 34 at any suitable location along the straight edge 48 of the ground element 30 or straight edge 62 of the coupling portion 60.

Alternatively, the feeding element 40 may couple to the ground and radiating elements 30, 32 yet be positioned such that the feeding element 40 does not extend across the first gap 34. For instance, the feeding element 40 may reach to the ground and radiating elements 30, 32 from a location remote from the first gap 34.

The coupling portion 60 comprises a first end 60*a* and a second end 60*b* opposite said first end 60*a*. In many embodiments, the first end 60*a* is proximal to the feeding element 40 and one of radiating segments 50*b* connects to the second end 60*b*.

The coupling portion 60 and radiating segments 50*a*, 50*b* may be integrally formed from a common material. Alternatively, the coupling portion 60 and radiating segments 50*a*, 50*b* may be separately formed and later combined to form the radiating element 32.

Each radiating segment 50*a*, 50*b* defines a proximal end 66 and an opposing distal end 68. The proximal end 66 of each radiating segment 50*a*, 50*b* connects to the coupling portion 60.

The proximal end 66 of one of the radiating segments 50*a*, 50*b* may connect to the coupling portion 60 at any suitable location between the first and second ends 60*a*, 60*b*. In such instances, the radiating segment 50, 50*b* does not extend from one of the first or second ends 60*a*, 60*b* of the coupling portion 60. For example, as shown in FIGS. 4-7, radiating segment 50*a* extends from the coupling portion 60 at a location approximately midway between the first and second ends 60*a*, 60*b*. In FIG. 6, both radiating segments 50*a*, 50*c* extend from locations between the first and second ends 60*a*, 60*b*.

Alternatively, one of the radiating segments 50*a*, 50*b* may extend from one of the first and second ends 60*a*, 60*b* of the coupling portion 60. For example, as shown in FIGS. 4-8, radiating segment 50*b* extends from the second end 60*b*. Additionally, in FIG. 8, radiating segment 50*a* extends from the first end 60*a* such that both radiating segments 50*a*, 50*b* extend from opposite respective first and second ends 60*a*, 60*b* of the coupling portion 60. The location from which the radiating segments 50*a*, 50*b* extend with respect to the coupling portion 60 may be chosen for aesthetic purposes or for purposes of affecting performance of the antenna 16. For example, the location from which the radiating segments 50*a*, 50*b* extend with respect to the coupling portion 60 may be chosen to affect the radiation pattern by adjusting the radiating current directions along the radiating segments 50*a*, 50*b*.

The feeding element 40 may connect to the coupling portion 60. Specifically, the second conductor 44 of the feeding element 40 may connect to the coupling portion 60 at any suitable location. For example, as shown in FIGS. 4-8, the second conductor 44 connects substantially proximal to the first end 60*a* of the coupling portion 60. The second conductor 44 may connect at any suitable location between the first and second ends 60*a*, 60*b*. Alternatively, the second conductor 44 may connect substantially proximal to the second end 60*b* of the coupling portion 60.

The radiating segments 50*a*, 50*b* in FIGS. 4-8 extend in a common direction along the second axis A2. That is, the radiating segments 50*a*, 50*b* extend from an outer edge 64 of the coupling portion 60 that is opposite the straight edge 62. The radiating segments 50*a*, 50*b* may extend from this side and in this direction such that the radiating segments 50*a*, 50*b* can be located in close proximity to transmit electrical currents along the same direction. This ensures that radiation fields of the radiating segments 50*a*, 50*b* construct each other, and do not destruct one another.

Alternatively, the radiating segments 50*a*, 50*b* may commonly extend from the straight edge 62 of the coupling portion 60. In yet another embodiment, one of the radiating segments 50*a*, 50*b* may extend from the outer edge 64 of the coupling portion 60 while another on of the radiating segments 50*a*, 50*b* extends from the straight edge 62 of the coupling portion 60. Of course, in any one these embodiments, the radiating segments 50*a*, 50*b* still extend parallel to one another along the second axis A2 regardless of which side of the coupling portion 60 they extend.

In one embodiment, as shown in FIGS. 4-7, for example, the distal end 68 of at least one of the radiating elements 50*a*, 50*b* is disconnected. In other words, the distal 68 is freely floating and not electrically connected to any other conductive part. In FIGS. 4-7, the distal ends 68 of both radiating segments 50*a*, 50*b* are disconnected. The freely floating distal end 68 has the function of parasitic loading. The distance between the disconnected distal end 68 and the ground plane effectively creates deeper resonances thereby providing better impedance matched antennas.

Alternatively, as shown in FIG. 8, the distal ends 68 of radiating segments 50*a*, 50*b* connect to one another by a connecting portion 70. As such, a closed loop forms between the coupling portion 60, radiating segments 50*a*, 50*b*, and connecting portion 70. Those skilled in the art appreciate that when the antenna has three or more radiating segments 50, the distal ends 68 of one or more radiating segments 50 may be disconnected while the distal ends 68 of other radiating segments 50 form a closed loop or closed loops.

The radiating segments 50*a*, 50*b* in FIGS. 4-8 are each substantially straight. In other words, the radiating segments 50*a*, 50*b* are neither bent nor folded. As such, in FIGS. 4-8, an entirety of the length of each of the radiating segments 50*a*, 50*b* extends substantially parallel to the second axis A2. The connecting portion 70 in FIG. 7 is not considered one of the radiating segments 50*a*, 50*b* as it does not extend substantially parallel to the second axis A2.

Figure 9:
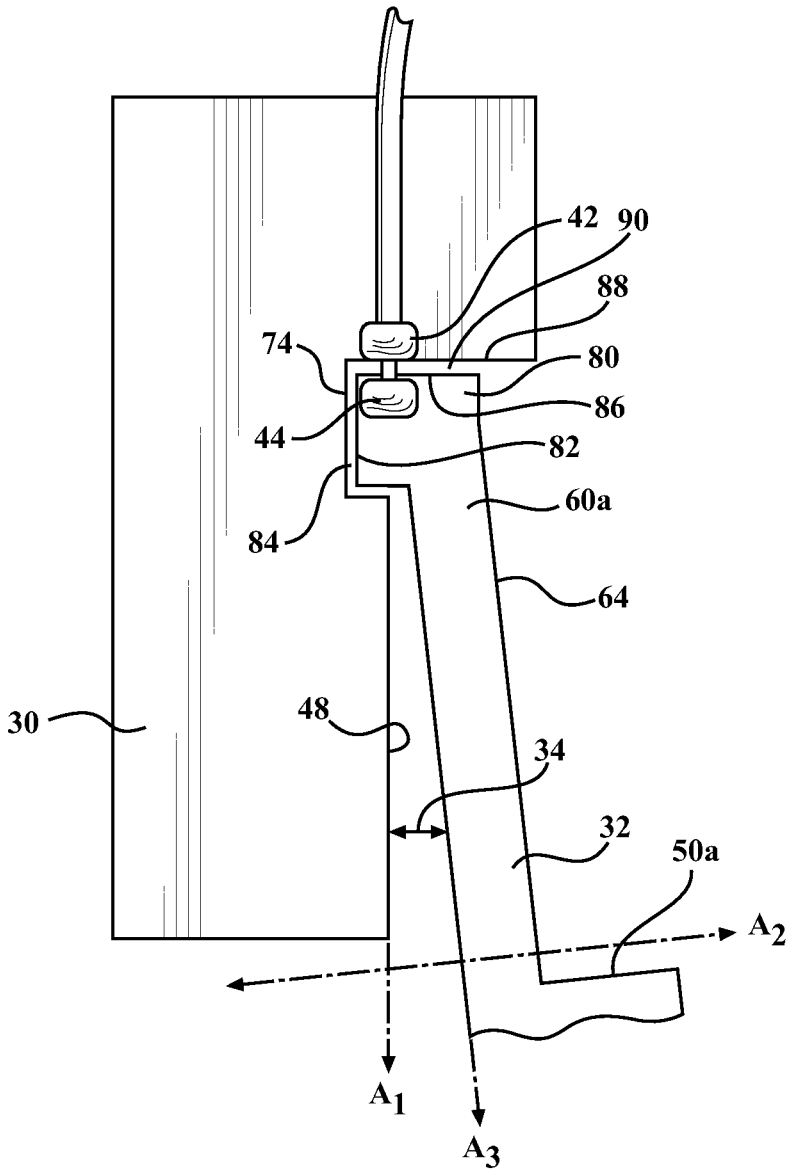
FIG. 9 is a zoomed-in view of a ground element and a radiating element of the antenna of FIG. 4.

FIG. 9 provides a zoomed-in view of an interface between the ground element 30 and radiating element 32 of the antenna 16 from FIG. 14. In FIG. 9, the ground element 30 defines a second straight edge 74 extending parallel to the first straight edge 48 of the ground element 30. The first and second straight edges 48, 74 are not disposed on the same line or co-linear. The second straight edge 74 faces the radiating element 32.

In FIG. 9, the radiating element 32 further includes a feed receiving portion 80 connected to and extending from the coupling portion 60. The feed receiving portion 80 is configured to receive the second conductor 44 of the feeding element 40.

In FIG. 9, the feed receiving portion 80 extends from the coupling portion 60 in a first direction transverse to the third axis A3. The radiating segments 50*a*, 50*b* extend from the coupling portion 60 in a second direction opposing the first direction. In FIG. 9, the feed receiving portion 80 further extends from the coupling portion 60 at the first end 60*a* of the coupling portion 60. Alternatively, the feed receiving portion 80 may extend from the coupling portion 60 at a location between the first and second ends 60*a*, 60*b* or directly from the second end 60*b*. The feed receiving portion 80 may be integrally formed as part of the coupling portion 60 or may be a separate component.

As shown in FIG. 9, the feed receiving portion 80 defines a first straight edge 82 extending parallel to and facing the second straight edge 74 of the ground element 30. A second gap 84 is defined between the second straight edge 74 of the ground element 30 and the first straight edge 82 of the feed receiving portion 80. The second gap 84 has a width that is substantially constant. The first gap 34 opens into the second gap 84. The second gap 84 may have any suitable width. In the embodiment of FIG. 9, the width of the second gap 84 is approximately 1 mm. In FIG. 9, the width of the second gap 84 is less than the width of the first gap 34.

In one variation of this embodiment, the first straight edge 82 of the feed receiving portion 80 may extend transverse (rather than parallel) to the second straight edge 74 of the ground element 30. In such instances, the width of the second gap 84 may be variable.

In one embodiment, the feeding element 40 connects to the radiating element 32 by extending across the second gap 84, rather than the first gap 32. In such instances, the first conductor 42 may connect substantially proximal to the second straight edge 74 of the ground element 30. The second conductor 44 may connect substantially proximal to the first straight edge 82 of the feed receiving portion 80.

In FIG. 9, the feed receiving portion 60 also defines a second straight edge 86 connected to and extending perpendicular to the first straight edge 82 of the feed receiving portion 60. The ground element 30 includes a third straight edge 88 connected to and extending substantially perpendicular to the second straight edge 74 of the ground element 30. In this embodiment, the third straight edge 88 of the ground element extends beyond the first straight edge 82 of the feed receiving portion 80. In FIG. 9, the third straight edge 88 extends substantially parallel to the second straight edge 74.

A third gap 90 is defined between the third straight edge 88 of the ground element 30 and the second straight edge 86 of the feed receiving portion 80. The third gap 90 has a width that is substantially constant. The second gap 84 opens into the third gap 90. The third gap 90 may have any suitable width. In the embodiment of FIG. 9, the width of the third gap 90 is approximately 1 mm, the same as the second gap 84.

In one variation of this embodiment, the third straight edge 88 of the ground element 30 may extend transverse (rather than perpendicularly) to the second straight edge 86 of the feed receiving portion 80. In such instances, the width of the third gap 90 may be variable.

In another embodiment, as shown in FIG. 9, the feeding element 40 extends across the third gap 90. In such instances, the first conductor 42 may connect substantially proximal to the third straight edge 88 of the ground element 30. The second conductor 44 may connect substantially proximal to the second straight edge 86 of the feed receiving portion 80.

The straight edges 48, 74, 88 of the ground element 30 and the straight edges 82, 86 of the feed receiving portion 80 may not be absolutely straight due to practical limitations, and the like. That is, certain portions of any of the straight edges 48, 74, 82, 86, 88 may include imperfections, notches, indentations, and the like. As such, as described above, each one of the straight edges 48, 74, 82, 86, 88 need be only straight such that a substantial majority of each one of the straight edges 48, 74, 82, 86, 88 visibly extends along a line when observed by the human eye.

As shown in FIG. 7, the antenna 16 may include a parasitic ground segment 94 disposed adjacent the ground element 30. The parasitic ground segment 94 may be formed of a conductive material, such as a metallic print. The parasitic ground segment 94 may have any suitable configuration, such as rectangular configuration (as shown in FIG. 7), an L-shaped configuration, a T-shaped configuration, and the like. The parasitic ground segment 94 is spaced from the antenna 16, and more specifically, the ground element 30. The parasitic ground segment 94 is electrically disconnected from the antenna 16 and is not directly energized from the feeding element 30. The antenna 16 may include any suitable non-conductive member for holding the parasitic ground segment 94 in place with respect to the ground element 30. In one embodiment, as shown in FIG. 7, the ground element 30 and the parasitic ground segment 94 each have a width defined perpendicular to the first axis A1. The width of the ground element 30 is substantially equivalent to the width of the parasitic ground segment 94. The parasitic ground segment 94 is indirectly energized to help to fine-tune the antenna 16 by provide radiation pattern altering benefits.

Additionally, as shown in FIG. 7, the ground element 30 may include first and second ground segments 96*a*, 96*b* extending integrally from the ground element 30. In this embodiment, the first and second ground segments 96*a*, 96*b* extend transverse, and more specifically, perpendicular to the straight edge 48 of the ground element 30. The first and second ground segments 96*a*, 96*b* extend parallel to one another and have a common length and width. Of course, similar to the radiating segments 50*a*, 50*b*, the first and second ground segments 96*a*, 96*b* may have different lengths and widths. A third ground segment 96*c* may connect the first and second ground segments 96*a*, 96*b*. In FIG. 7, the third ground segment 96*c* connects distal ends of the first and second ground segments 96*a*, 96*b* to one another. As such, a closed loop is formed between the ground segments 96*a*, 96*b*, 96*c* and the straight edge 48 of the ground element 30. The ground segments 96*a*, 96*b*, 96*c* in FIG. 7 are each substantially straight. The ground segments 96*a*, 96*b*, 96*c* provide improved impedance matching properties to the ground element 30 and may help tune the antenna 16.

Figure 10:
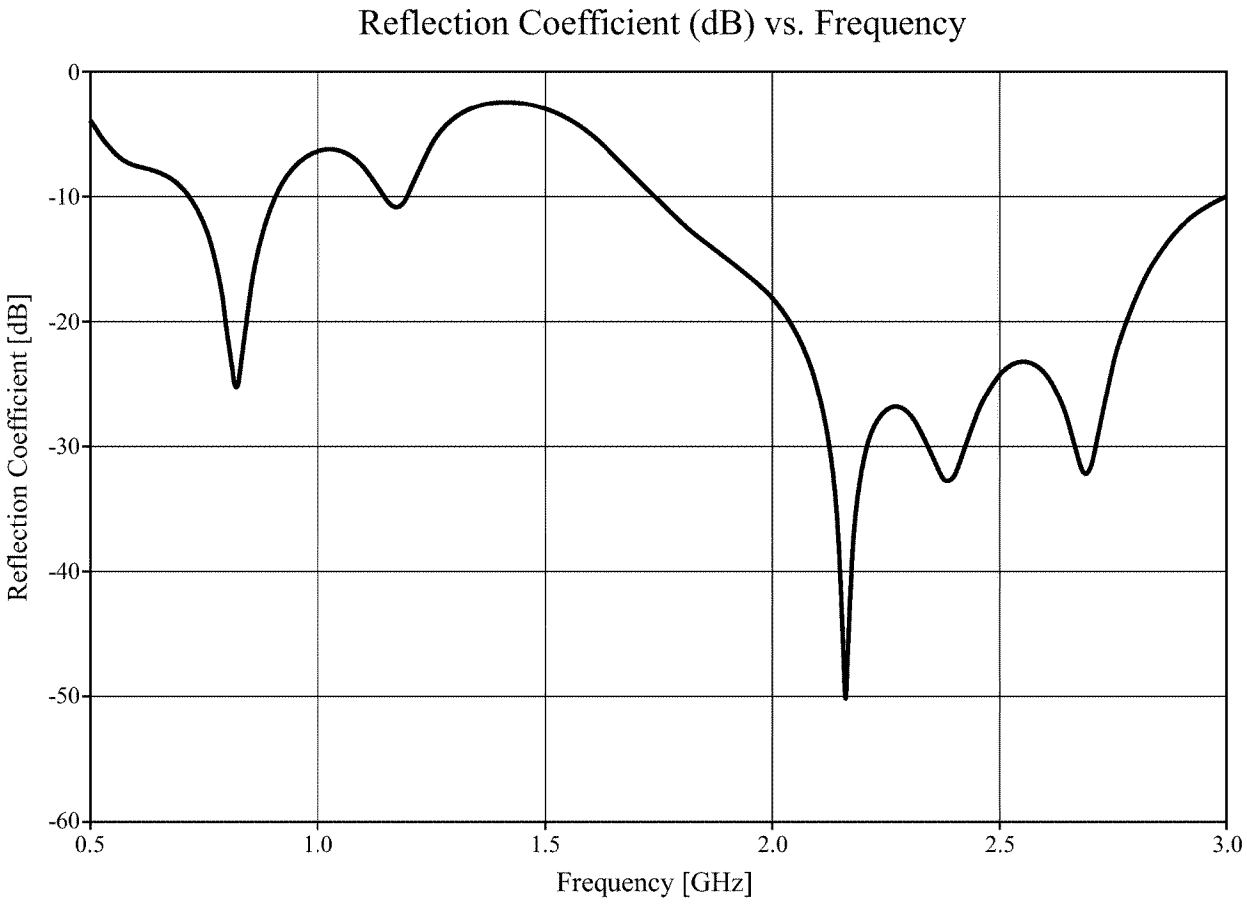
FIG. 10 is a frequency-gain chart for the antenna of FIG. 4.

FIG. 10 is a frequency-gain chart for the antenna 16 of FIG. 4. More specifically, FIG. 10 compares reflection coefficient measured in dB for a frequency spectrum representative of the LTE communication band, i.e., between 0.5-3.0 GHz. As illustrated, the antenna 16 exhibits excellent (below −7 dB) reflection coefficient over a majority of the LTE communication band. Between a wideband of approximately 1.75-2.75 GHz, the antenna 16 exhibits reflection coefficient consistently below −20 dB. Additionally, the reflection coefficient spikes at approximately 0.7 GHz. Thus, FIG. 10 illustrates the advantageous multi-band behavior of the antenna 16. Although FIG. 10 illustrates performance of the antenna 16 of FIG. 4, any of the embodiments of FIGS. 5-8 may similarly exhibit such performance by virtue of their similarities as described herein.

Figure 11:
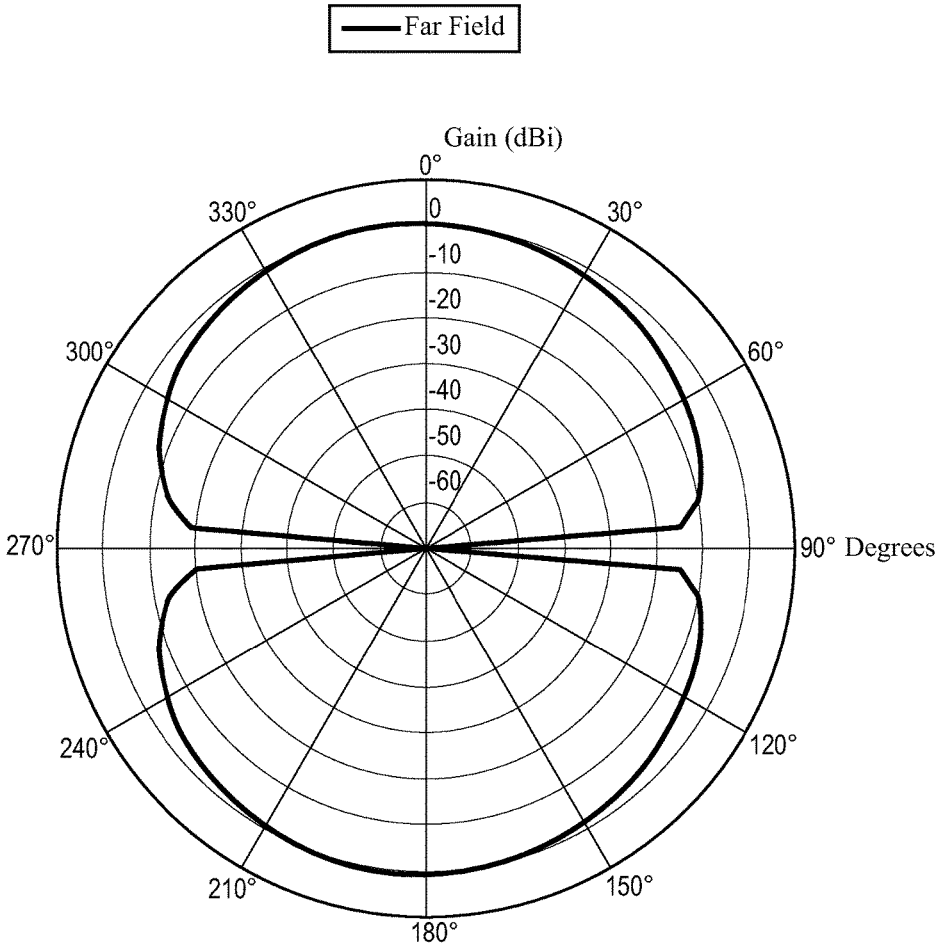
FIG. 11 is a far-field gain pattern at 840 MHz for the antenna of FIG. 4.
Figure 12:
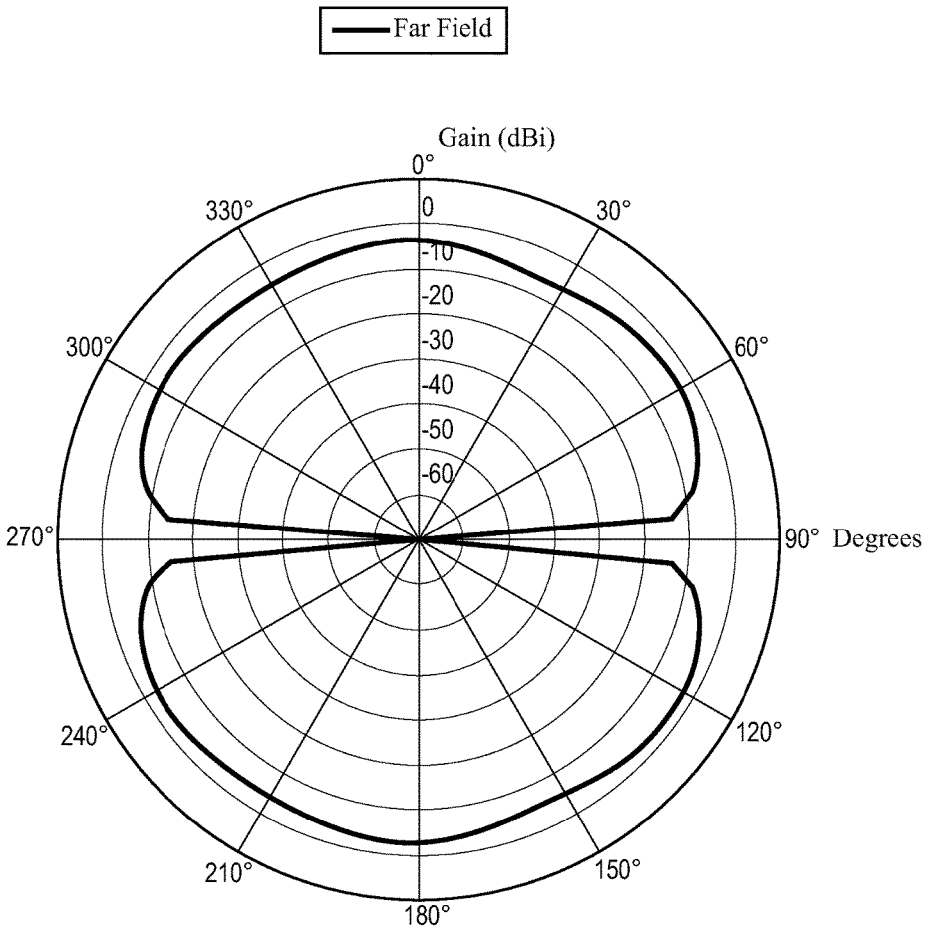
FIG. 12 is a far-field gain pattern at 1940 MHz for the antenna of FIG. 4.
Figure 13:
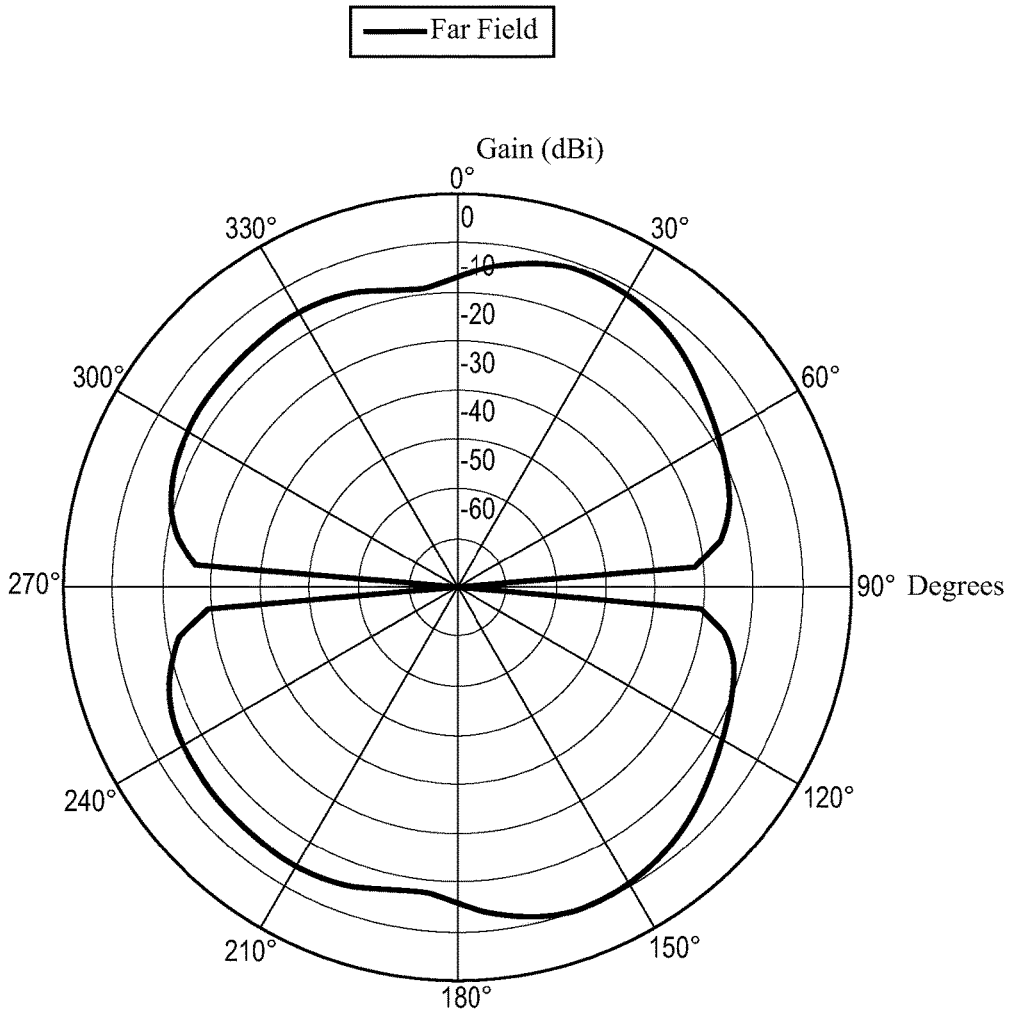
FIG. 13 is a far-field gain pattern at 2500 MHz for the antenna of FIG. 4.

FIGS. 11-13 illustrate far field gain patterns for the antenna of FIG. 4. In FIG. 11, the far field gain was measured at 840 MHz. In FIG. 12, the far field gain was measured at 1940 MHz. In FIG. 13, the far field gain was measured at 2500 MHz. Despite a broad range of the frequencies in the measured spectrum, i.e., between 840-2500 MHz, the far field gain is very similar in each of FIGS. 11-13. That is, in each of FIGS. 11-13, the far field gain is symmetric about the horizontal 90/270 degree line and consistently between −10 and −20 dBi for a substantial majority of the angular range (0-360 degrees). Thus, the antenna 16 exhibits substantial omni-directionality over the broad range of frequencies. Although FIGS. 11-13 illustrate performance of the antenna 16 of FIG. 4, any of the embodiments of FIGS. 5-8 may similarly exhibit such performance.

The present invention has been described herein in an illustrative manner. It is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A window assembly comprising:

a substrate defining a surface;

an antenna disposed on said surface of said substrate, said antenna comprising:

a ground element defining a straight edge extending along a first axis;

a radiating element spaced apart from said ground element; and a feeding element having a first conductor coupled to said ground element and a second conductor coupled to said radiating element;

said radiating element comprising:

two radiating segments extending substantially parallel to one another along a second axis transverse to said first axis with each radiating segment defining a width measured perpendicular to said second axis with said width of one radiating segment being greater than said width of said other radiating segment; and a coupling portion comprising a straight edge facing said straight edge of said ground element and an outer edge opposite said straight edge, and wherein said straight edge and said outer edge of said coupling portion extend along a third axis being transverse to said first axis, and wherein said radiating segments extend from said outer edge of said coupling portion in a direction away from said ground element.

2. The window assembly of claim 1 wherein a first gap is defined between said straight edge of said ground element and said straight edge of said coupling portion of said radiating element with said first gap having a width that varies between said straight edges.

3. The window assembly of claim 2 wherein said feeding element extends across said first gap, and wherein said first conductor is connected substantially proximal to said straight edge of said ground element, and wherein said second conductor is connected substantially proximal to said straight edge of said coupling portion.

4. The window assembly of claim 2 wherein said ground element defines a second straight edge extending parallel to said first straight edge of said ground element and facing said radiating element, and wherein said radiating element further comprises a feed receiving portion connected to and extending from said coupling portion and defining a first straight edge extending parallel to and facing said second straight edge of said ground element.

5. The window assembly of claim 4 wherein a second gap is defined between said second straight edge of said ground element and said first straight edge of said feed receiving portion with said second gap having a width that is substantially constant.

6. The window assembly of claim 5 wherein said feeding element extends across said second gap, and wherein said first conductor is connected substantially proximal to said second straight edge of said ground element, and wherein said second conductor is connected substantially proximal to said first straight edge of said feed receiving portion.

7. The window assembly of claim 4 wherein said coupling portion comprises a first end and a second end opposite said first end and with one of said radiating segments connecting to said second end, and wherein said feed receiving portion extends from said coupling portion in a first direction transverse to said third axis, and wherein said radiating segments extend from said coupling portion in a second direction opposing said first direction.

8. The window assembly of claim 7 wherein said feed receiving portion extends from said coupling portion at a location between said first and second ends.

9. The window assembly of claim 7 wherein said feed receiving portion extends from said coupling portion at said first end.

10. The window assembly of claim 4 wherein said feed receiving portion defines a second straight edge connected to and extending perpendicular to said first straight edge of said feed receiving portion, and wherein said ground element comprises a third straight edge connected to and extending perpendicular to said second straight edge of said ground element with said third straight edge of said ground element extending beyond said first straight edge of said feed receiving portion.

11. The window assembly of claim 10 wherein a third gap is defined between said third straight edge of said ground element and said second straight edge of said feed receiving portion with said third gap having a width that is substantially constant.

12. The window assembly of claim 11 wherein said feeding element extends across said third gap, and wherein said first conductor is connected substantially proximal to said third straight edge of said ground element, and wherein said second conductor is connected substantially proximal to said second straight edge of said feed receiving portion.

13. The window assembly of claim 1 wherein a first angle is defined between said first and third axes, and wherein a second angle is defined between said first and second axes, and wherein a third angle is defined between said second and third axes, and wherein said first angle is greater than 5 degrees and less than 15 degrees, and wherein said second angle is greater than 80 degrees and less than 100 degrees, and wherein said third angle is greater than 75 degrees and less than 100 degrees.

14. The window assembly of claim 13 wherein said third angle is approximately 90 degrees such that said radiating segments extends substantially perpendicular with respect to said straight edge of said coupling portion.

15. The window assembly of claim 1 wherein each radiating segment defines a length measured parallel to said second axis with said length of one radiating segment being greater than said length of said other radiating segment.

16. The window assembly of claim 1 wherein each radiating segment defines a length measured parallel to said second axis with said length of one radiating segment being equal to said length of said other radiating segment.

17. The window assembly of claim 16 wherein said width of each radiating segment is greater than said length of each radiating segment.

18. The window assembly of claim 16 wherein said length of each radiating segment is greater than said width of each radiating segment.

19. The window assembly of claim 1 wherein each radiating segment defines a proximal end and an opposing distal end with said proximal end being connected to said coupling portion and said distal end being disconnected.

20. The window assembly of claim 1 wherein each radiating segment defines a proximal end and an opposing distal end with said proximal end being connected to said coupling portion and with said distal ends of said radiating segments being connected to one another by a connecting portion.

21. The window assembly of claim 1 wherein said ground element and said radiating element each define a surface area wherein said surface area of said ground element is greater than said surface area of said radiating element.

22. The window assembly of claim 21 wherein said surface area of said ground element is greater than 1500 $mm^2$ and less than 2500 $mm^2$, and wherein said surface area of said radiating element is greater than 500 $mm^2$ and less than 1500 $mm^2$.

23. The window assembly of claim 1 further comprising a third radiating segment extending substantially parallel to said two radiating segments along said second axis.

24. The window assembly of claim 1 wherein said ground element and said radiating element each have a flat configuration.

25. The window assembly of claim 1 wherein said ground element and said radiating element are disposed coplanar on said surface of said substrate.

26. The window assembly of claim 1 wherein said substrate comprises a peripheral edge and wherein said radiating element and ground element are disposed within said peripheral edge of said substrate.

* * * * *